United States Patent [19]

Ebel et al.

[11] 4,012,618

[45] Mar. 15, 1977

[54] METHOD AND APPARATUS FOR THE SUCCESSIVE WELDING OF CONSECUTIVE CHAIN LINKS

[75] Inventors: Bruno Ebel; Günter Krumholz; Paul Rahn, all of Cologne, Germany

[73] Assignee: Meyer, Roth & Pastor Maschinenfabrik GmbH, Cologne, Germany

[22] Filed: Feb. 25, 1975

[21] Appl. No.: 553,039

[30] Foreign Application Priority Data

Feb. 25, 1974 Germany ..... 2408971
Dec. 23, 1974 Germany ..... 2461252

[52] U.S. Cl. ..... 219/52; 59/31; 219/51; 228/192

[51] Int. Cl.[2] ..... B21L 3/00

[58] Field of Search ..... 59/31, 33, 34, 22; 219/51, 52; 228/192

[56] References Cited

UNITED STATES PATENTS

| | | | |
|---|---|---|---|
| 2,405,510 | 8/1946 | Maytag | 219/51 |
| 2,464,875 | 3/1949 | Lewis et al. | 219/51 |
| 3,389,552 | 6/1968 | Kleine-Weischede | 59/31 X |
| 3,552,118 | 1/1971 | Reiter et al. | 59/31 X |
| 3,701,253 | 10/1972 | Wüst | 59/31 |
| 3,934,407 | 1/1976 | Lange | 59/31 |

*Primary Examiner*—Arthur T. Grimley
*Assistant Examiner*—N. D. Herkamp
*Attorney, Agent, or Firm*—Spencer & Kaye

[57] ABSTRACT

For the successive welding of the joints of consecutive links forming a link chain, the chain is advanced in a chain welding machine to bring a link to be welded directly below a welding position; the two links flanking the link to be welded are aligned in a common plane of alignment while a tensioning force is applied to the chain parallel to the direction of chain advance. Thereafter, the link to be welded is raised into a welding position in a plane disposed at 90° to the plane of alignment. Subsequently, the link is immobilized in the welding position and its joint is welded. Upon completion of the welding step, the just-welded link is lowered from the welding position.

4 Claims, 9 Drawing Figures

II

METHOD AND APPARATUS FOR THE SUCCESSIVE WELDING OF CONSECUTIVE CHAIN LINKS

BACKGROUND OF THE INVENTION

This invention relates to a method and apparatus for the successive electrical welding of consecutive chain links interconnected to form a link chain.

According to known methods, the chain link joints which are staggered 90° from link to link have been advanced in the chain link welding machine in such a manner that each chain link to be welded has been positioned in a welding saddle in an edgewise upright orientation with the joint to be welded facing upward. Accordingly, in such a known arrangement only every other link can be welded in the course of one pass of the chain, so that for completing the welding, the chain has to execute two passes through the welding machine.

SUMMARY OF THE INVENTION

It is an object of the invention to provide an improved chain welding method and apparatus for the successive welding of consecutive chain links in the course of a single pass.

This object and others to become apparent as the specification progresses, are accomplished by the invention, according to which, briefly stated, the chain is advanced in a chain welding machine to bring a link to be welded directly below a welding position; the two links flanking the link to be welded are aligned in a common plane of alignment while a tensioning force is applied to the chain parallel to the direction of chain advance. Thereafter, the link to be welded is raised into a welding position in a plane disposed at 90° to the plane of alignment. Subsequently, the link is immobilized in the welding position and its joint is welded. Upon completion of the welding step, the just-welded link is lowered from the welding position.

By means of the above-outlined method, it is possible to orient upright the chain link to be welded without the need of complex turning mechanisms by virtue of the aligning effect of the chain links on one another and to maintain the chain link to be welded in its upright-oriented position until the upsetting tools and/or electrodes set the chain link in its final welding position.

According to a preferred embodiment of the invention, portions of the still unwelded and the already welded chain are guided on the throughgoing chain link legs of their chain links, while the unwelded or, as the case may be, the welded joints of the individual chain links are oriented upwardly. Further, the two chain links adjoining the chain link to be welded are aligned, by lifting, in a common plane defined by the axes of the two link legs of both links adjoining the link to be welded. This method has the advantage that the guiding step ensures that the joints of the chain links are always oriented towards the welding electrodes and that, by means of the above-noted lifting operation, at least the two links flanking the link to be welded may align themselves in the common plane independently from the chain guide means and thus align the chain link to be welded in a plane extending perpendicularly to the above-noted common plane of alignment. As a result, the chain link to be welded can be engaged by the upwardly moved saddle in the proper position and lifted further into the welding position.

The invention further relates to a chain link welding machine for performing the above-outlined method, having welding electrodes, upsetting tools and a saddle for the chain link to be welded, as well as guide means associated with the welding position for guiding the chain to and from the welding position. According to the invention, the guide means terminate in the zone of the welding position at such a distance from the saddle that at least those two chain links which immediately flank the link to be welded, are accessible freely from below and further, viewed in the direction of chain advance, adjacent both longitudinal ends of the saddle there are disposed separate aligning elements affecting the position of the two flanking links. Further, the saddle is movable vertically up and down with respect to the welding position and may be immobilized therein.

By means of an apparatus designed as outlined above, the two chain links flanking the chain link to be welded are, by means of the two movable aligning elements, positioned in a simple manner in a common plane and thus, by means of the vertically movable and lockable saddle, the chain link to be welded — which assumes a position perpendicular to the above-mentioned common plane — can be brought into the welding position. The saddle is, for the purpose of removing the load from the saddle lifting device, designed to be lockable so that the pressure exerted on the chain link by the upsetting tools and the electrodes is not transmitted to the saddle lifting device, but is absorbed by the saddle-locking mechanism.

According to a further feature of the invention, both aligning elements have an aligning edge which, in their aligning position, maintains the two flanking chain links in a common plane and further, the aligning elements are connected with at least one common drive mechanism, but preferably have separate drive mechanisms of their own. According to a further feature of the invention, the aligning elements are designed to approach the flanking chain links from below. In this manner, it is possible to position the aligning elements, or at least the driving device and the motion-transmitting mechanism in the zone below the chain path. As a result of such an arrangement, the upsetting tools, the electrodes and the de-flashing mechanisms are not adversely affected in their operation.

According to a further feature of the invention, the two aligning elements are supported in such a manner that each is pivotal in a vertical plane. In this manner it is possible to dispose the support externally of the effective zone of the welding position so that no damages due to weld squirts, etc., can occur. A further advantage of this arrangement resides in the fact that an adjustable leverage for the aligning elements can be provided, so that an adaptation to various link dimensions may be achieved while keeping the aligning stroke as small as possible. In this connection it is particularly advantageous to arrange the pivotal points above the path of the link chain. In such an arrangement it is possible, despite the design of the aligning elements as pivotal arms, to ensure an approximately linear, vertically oriented aligning stroke in the zone of the aligning edges of the aligning elements.

It is a further feature of the invention to releasably secure the saddle on a lifting device connected with a drive mechanism. The lifting device is provided with a mechanism for adjusting the height position of the saddle. With the aid of this arrangement it is possible to effect in a simple manner an adaptation of the device to different chain link dimensions of different chain types.

According to a further feature of the invention, the chain guide means arranged in the zone of the saddle has a trough-like configuration and at least those ends of the walls of the trough which are oriented towards the welding position are adjustable in width. Such an arrangement makes possible to exactly adjust the guide means in a simple manner to the individual chain link dimensions, while it is ensured that the chain links in each instance are guided on their throughgoing chain link legs and thus the unwelded and welded joints, respectively, of the chain portion that is advanced towards or withdrawn from the welding position, are oriented upwardly. Thus each chain link is, in a simple manner, oriented in the guide means at 45° with respect to the alignment plane.

According to another feature of the invention, at those ends of the guides that are oriented away from the welding position, there are provided means for generating a tensioning force which essentially acts in the longitudinal direction of the chain. These means are formed, according to a preferred embodiment of the invention, of the respective advancing mechanisms for each chain portion upstream and downstream of the saddle and are each provided with a controllable drive. The tensioning force is generated directly by the drives for the conveying mechanisms in such a manner that the chain portion moving towards the saddle is advanced with a slightly lower speed than the (welded) chain portion withdrawn from the saddle. As a result the chain between the two conveying mechanisms is slightly tensioned and thus, in cooperation with the aligning edges of the aligning elements, the chain link to be welded is positioned as described before. It is further feasible to generate the above-outlined tensioning force by predetermined length portions of the chain freely suspended between the respective ends of the guides and the chain advancing wheels arranged at a distance from the respective ends of the two guides.

According to another feature of the invention, the means for generating the above-explained tensioning force comprises at least one spring-biased pawl which engages into the chain and wherein the force of the spring associated with the pawl is directed opposite to the direction of chain advance.

In accordance with a further feature of the invention the guides are arranged at an angle — preferably symmetrically — to an axis passing vertically through the welding position while the inlet and outlet ends of the guide are disposed beneath the welding position. The angle of each guide to the horizontal is less than 90°, and preferably approximately 20°. By arranging the two guides at an angle (preferably at an angle of approximately 20°), there is exerted by the flanking links an optimal aligning force on the chain link during its lifting into the welding position.

According to another feature of the invention the guides, at least in the zone of their ends oriented towards the welding position, have an at least partially substantially horizontally extending terminal edge and the distance from these terminal edges to the saddle is so designed that at least the two chain links that flank the chain link to be welded can lie on the terminal edges with both chain link legs. This arrangement has the advantage that a turning of the chain link to be welded may be effected practically without movable components, because under the effect of the weight of the chain extending downwardly at both sides, there is generated a sufficiently large tensioning force which presses the two flanking chain links with their two chain link legs onto the respective terminal edges and these two chain links are thus brought into the common plane of alignment. In this manner, the chain link to be welded is positioned at an angle of 90° with respect to the common plane of alignment, so that by merely lifting it with the aid of the saddle, it is brought into the welding position and may be firmly held by the upsetting tools on the raised, immobilized saddle before the welding electrodes are positioned on the end of the chain link leg to be welded.

It is a further feature of the invention to so design the chain guides that at least in the zone of their ends oriented towards the welding position they have a trough-shaped configuration. With this arrangement it is ensured in a simple manner that the chain links are forcibly guided on the chain link legs and thus the unwelded and welded joints, respectively, of the incoming and exiting chain portions are oriented upwardly. Thus, in a simple manner, each chain link is oriented 45° with respect to the aligning plane defined by the terminal edges of the guides. This arrangement ensures that the chain link to be welded is oriented with the joint facing upwardly, that is, it is oriented towards the welding electrodes as soon as it enters the intermediate space between the two terminal edges of the guides and the chain link legs of the two flanking chain links are in engagement with the terminal edges of the guide. Thus, the turning process involves only a rotation of the chain link to be welded by 45° so that the time needed for advancing and aligning the chain link to be welded may be reduced to a minimum value.

According to a further feature of the invention, in the zone of those terminal edges of the guides which are oriented toward the saddle, there is provided a separate aligning element. In this manner the chain link turning step and the exact positioning of the chain link to be welded with respect to the saddle are improved.

A further improvement may be achieved if, according to the invention, the aligning element has a wedge-shaped run-in portion at that end of the guide which is oriented away from the terminal edge of that guide. In this manner, an entanglement of the individual chain links on the aligning elements is prevented and there is ensured a practically jar-free advance of the chain.

Still another feature of the invention provides that the width of each aligning element is less than the smaller distance between the legs of one chain link. This arrangement has the advantage that the aligning element can be arranged practically directly at the terminal edge forming part of the guide and determining the alignment plane. During the aligning step, the aligning element is disposed in the free intermediate space within the chain link lying on the terminal edge. As a result, the alignment of the chain links in the alignment plane is not impeded, while, in the end zone of the guides, which is particularly important for the aligning step, the chain link leg which engages the bottom of the guide is guided exactly in the alignment position onto the terminal edge of the guides. At the same time, there is effected an adjustment of the chain link — held between the two flanking chain links engaging the terminal edge or, as the case may be, the aligning edge of the guide — with respect to the saddle.

A further feature of the invention provides that the saddle having a groove for receiving one of the chain link legs is provided with at least one lug at each side of the saddle groove. Each lug has a slide face arranged at an inclination with respect to the groove. This arrangement provides that as the saddle is raised, the chain link to be welded and positioned between the two flanking chain links oriented in the alignment plane, can be securely grasped and brought into the welding position.

According to still another feature of the invention, in the zone of those guide ends which are oriented away from the welding position, means are provided for generating a tension force which acts essentially in the longitudinal direction of the chain. These means comprise, according to the invention, the conveying mechanism itself for the two chain length portions on either side of the saddle. Each conveying mechanism is provided with a controllable drive. The tensioning force is generated directly by the drive of the conveying mechanism in such a manner that the chain has, in the zone of its advance towards the saddle, a speed which is slightly smaller than in the zone where the chain portion is withdrawn from the saddle. As a result, the chain is, between the two conveying devices, slightly tensioned and thus, in cooperation with the aligning terminal edges of the guides, the chain link to be welded is brought into position in a reliable manner. The tensioning force may be generated by a chain portion of predetermined length which hangs freely between the one or the other guide end and a conveying wheel disposed at a distance from the respective guide end. Dependent upon the design of the inclined guides, the own weight of the partial chain portions disposed on the guide may suffice.

DESCRIPTION OF THE PREFERRED EMBODIMENTS

Figures 1, 2:
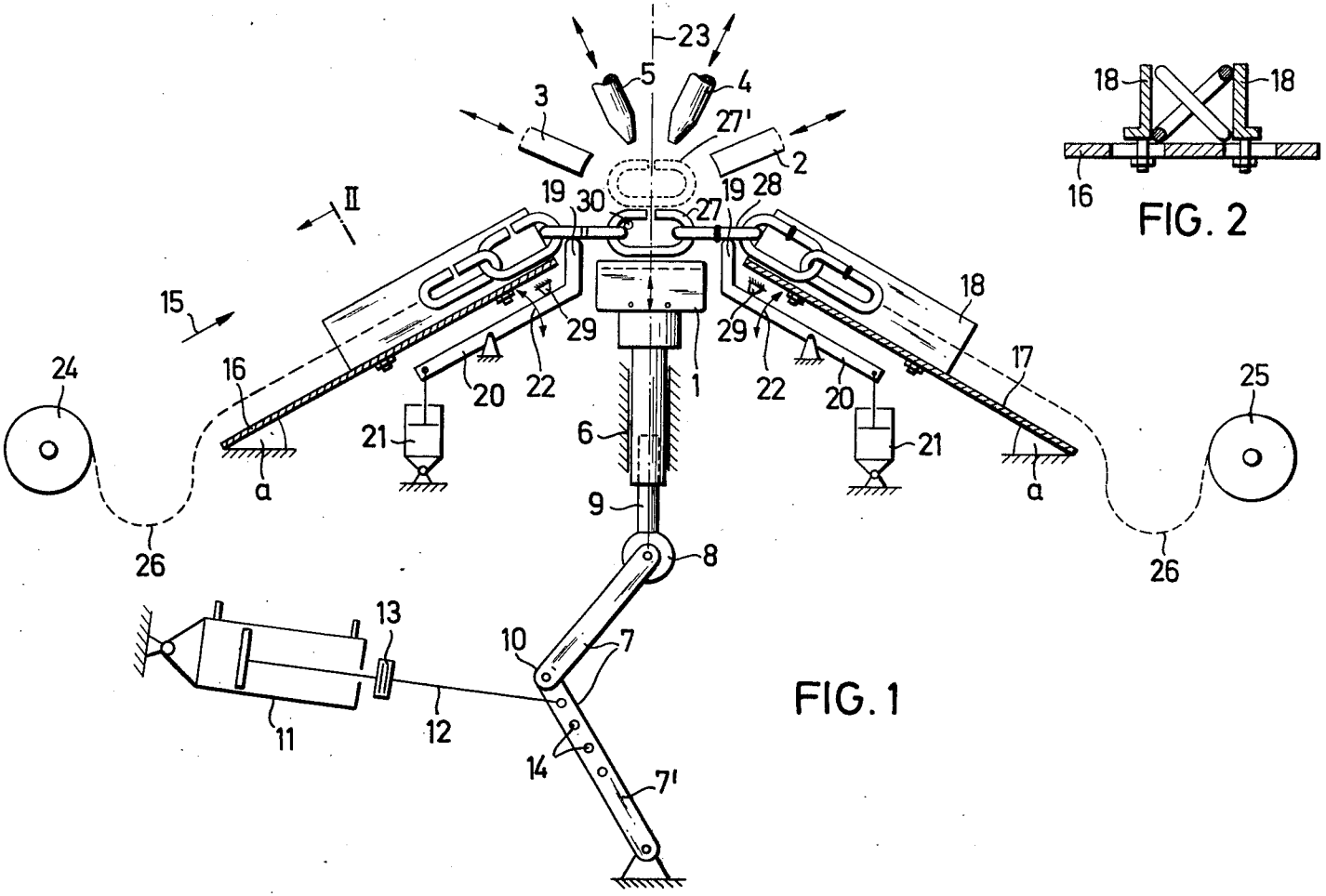
FIG. 1 is a schematic, partially sectional side elevational view of a preferred embodiment of the invention.
FIG. 2 is a sectional view taken along line II—II of FIG. 1.
Figure 3:
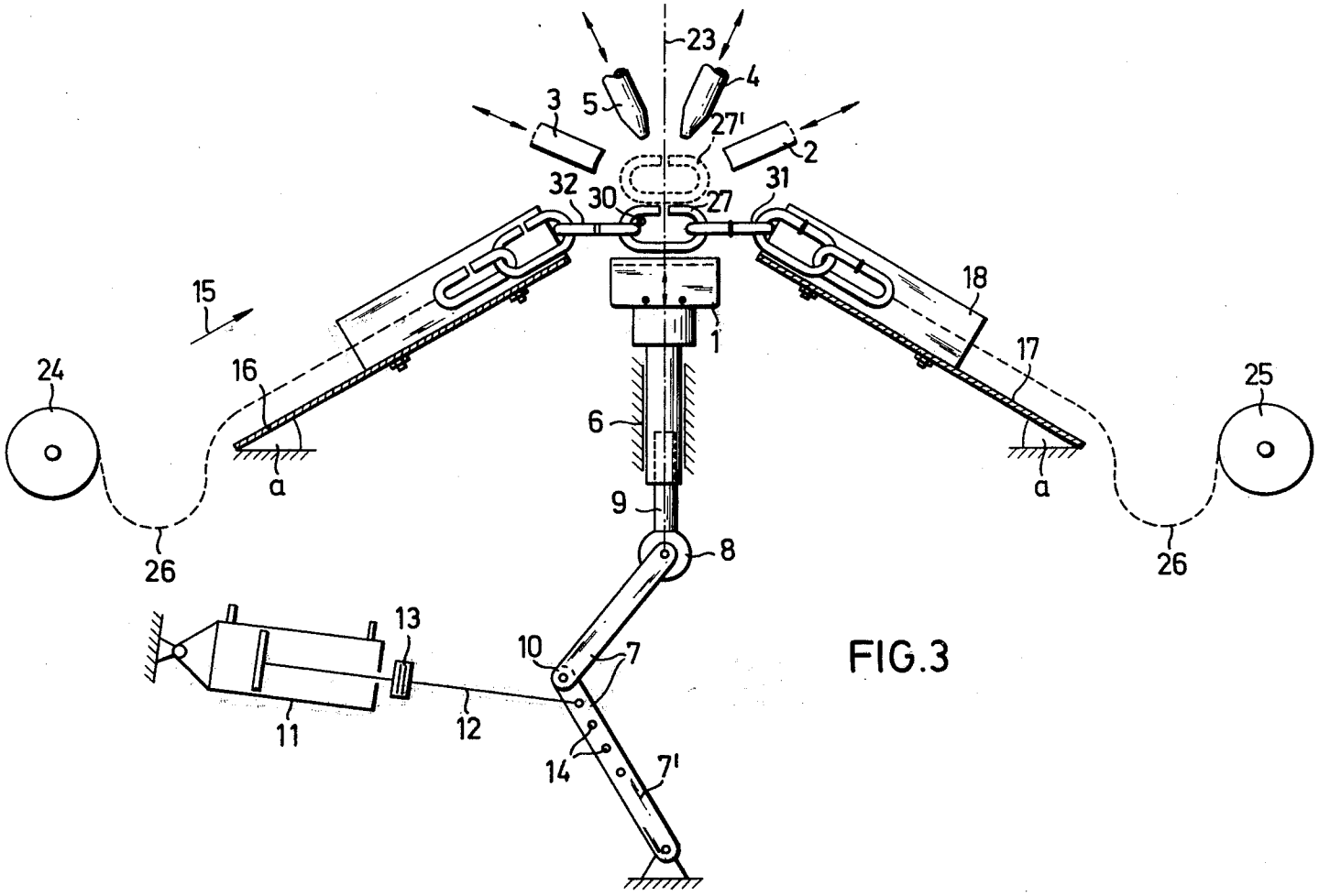
FIG. 3 is a schematic, partially sectional side elevational view of another preferred embodiment of the invention.

Turning now to FIG. 1, in a machine frame not shown, above a vertically movable saddle 1 there are arranged two upsetting tools 2, 3 and electrodes 4, 5 which expediently form an electrode pair. Both the upsetting tools and the electrodes are movable in a conventional manner so that they may be shifted towards and away from a chain link maintained in a welding position on the saddle 1.

The saddle 1 is dismountably secured to a guide rod 6 which is connected with a toggle drive 7. Between an end joint 8 of the toggle drive 7 and the guide rod 6 there is arranged an intermediate shank 9 by means of which the height of the saddle 1 for its raised position can be set to thus adapt it to different chain link dimensions.

The toggle drive 7 is connected in the zone of the toggle joint 10 with a drive mechanism 11 which, in the embodiment illustrated, is designed as a double-action hydraulic cylinder. For limiting the return stroke, it is expedient to arrange an adjustable abutment 13 (such as an annular clamping element) on the piston rod 12. The abutment 13 should be disposed with respect to the piston rod 12 in such a manner that the setting range of the piston rod always lies beyond the cylinder seals. For affecting the stroke speed of the toggle drive 7, it is expedient to adjustably secure the piston rod 12 at the lower lever 7'. Thus, as seen in FIG. 1, by selecting, for the piston rod 12, one of the connecting holes 14 arranged in the lower toggle lever 7' at a distance with respect to one another, the leverage for exerting the setting force of the drive cylinder may be set.

It is noted, however, that the invention is not limited to a saddle lifting device designed as a toggle drive. Thus, lifting devices may be used which have a cam disc of the driving key lock type or the like. A desirable requirement of any saddle lifting device is merely the possibility of immobilizing the same in the lifted position, that is, in the welding position, in order to absorb the pressure forces exerted on the link by the upsetting tools and the electrodes.

As viewed in the direction of chain advance (arrow 15) upstream and downstream of the saddle 1 there are arranged chain guides 16 and 17, respectively. As it may be observed in FIG. 2, the lateral walls 18 of the channel-shaped guides are transversely adjustable to vary the channel width to ensure that the links of the chain are disposed at all times in the channels at 45° with respect to the channel bottom.

The guides terminate in the zone of the saddle 1 at such distance from the saddle that there remains sufficient space to introduce, preferably from below, an aligning element between the saddle and the terminal edge of the guide. In the embodiment illustrated, each guide element comprises a web 19 which is secured to a pivotally supported arm 20 and which has a horizontal terminal aligning edge. The pivotal arm 20 is connected to a drive mechanism, for example, a hydraulic cylinder 21, so that it can be oscillated back and forth as indicated by the arrow 22.

As it may be observed from FIG. 1, the two guides 18 are arranged at an angle, preferably in a symmetrical manner, with respect to an axis 23 which passes vertically through the welding position. Thus, the inlet end and outlet end of the guides are situated below the welding position so that by providing a chain advancing wheel 24 and 25 at a distance from the respective channel ends for forwarding the chain towards and, respectively, withdrawing it from the saddle 1, there may be formed chain portions 26, the length of which may be predetermined, for generating, by their own weight, a tension force which supports the aligning effect of the aligning elements 19, 20.

Instead of generating a tension force by the own weight of a chain portion, it is also feasible to arrange the conveying wheels 24 and 25 flush with the respective guide 18 and provide that there is a slight difference in the speed with which the forwarding wheel 25 and the withdrawing wheel 24 are driven to generate in this manner a slight tensioning of that chain portion which is situated between the two conveying wheels 24 and 25.

The method according to the invention as performed with the apparatus discussed in connection with FIGS. 1 and 2 is thus as follows.

Prior to welding and while the saddle 1 and the aligning elements 19 are in their lowered position, the chain is moved by means of a chain conveying mechanism (not shown in detail) to such an extent that the chain link 27 to be welded assumes a position directly below the welding station and below the welding position. Thereafter, the aligning elements 19 are, by means of their drive 21, pivoted upwardly to such an extent that the two chain links 28 flanking the chain link 27 are slightly lifted to the level of the chain link 27 and fully engage the aligning edge of the aligning element 19 in a plane which is formed by two legs of either link 28. Since, for example, by means of the adjustable abutments 29 care is taken that the aligning edges of the two aligning elements 19 lie in a single plane, the flanking chain links 28 will be aligned accordingly and thus position the chain link 27 to be welded, under the additional effect of the earlier-described tensioning force. Thereafter, by means of the lifting device 7, 11, the saddle 1 is raised to such an extent until it brings the chain link 27 into the welding position 27', whereby the flanking links 28 assume an inclined orientation. Since the guides 18 form with the horizontal an angle *a* of preferably 20°, the flanking chain links 28 thus exert an optimal aligning force on the chain link 27 in such a manner that the latter is aligned in the welding position 27' on the saddle 1 in a practically exact vertical orientation without additional aligning means.

Thereupon, the upsetting tools and the electrodes are moved into their operational position towards the chain link 27, while simultaneously the aligning elements 19, which are no longer in contact with the chain, are lowered. Subsequent to the welding step, first the electrodes and then, after a time lapse determined by the welding conditions, the upsetting tools are withdrawn. Thereafter, the saddle 1 is lower and the welded chain link is released. By means of the chain conveying mechanism, the consecutive chain link is brought into its predetermined position above the saddle 1, whereby the just-welded chain link takes over the function of the downstream flanking link, whereas the chain link which earlier functioned as the downstream flanking link, is again disposed, as shown in FIG. 2, in the guide 18 at 45° to the channel bottom. Thereafter, the above-described welding operation is repeated.

It is thus seen that by virtue of the welding method according to the invention, it is feasible to operate with high chain welding speeds, since all the steps where movements are involved, are effected with a relatively very short stroke and thus can be carried out in the shortest possible time. By practicing the invention as explained above, the intermediate inner transporting mechanisms required in methods known heretofore may be omitted with all their disadvantages.

According to an advantageous feature of the invention, on the saddle 1 there is arranged a device for generating an electromagnetic short circuit which affects the chain link 27 to be welded from the still unwelded (upstream) side of the chain portion. In this manner, advantageously, the electromagnetic asymmetry appearing during the welding process may be equalized. This asymmetry arises by virtue of the fact that on the one side of the link 27 there is a fully welded (closed) chain link whereas on the other side of the link 27 there is situated a still unwelded chain link 28 having an air gap at its joint. Thus, the magnetic fluxes associated with the one and the other flanking links 28 have substantially different values. Therefore, for eliminating the above-explained asymmetry, on the side of the unwelded chain portion, there is inserted through the loop of the chain link 27 a correspondingly dimensioned pin 30 so that on both sides there will be a connection with the machine frame. In this manner, there is generated a closed magnetic circuit which, in its effect on the welding process, corresponds to the effect of the chain link 28. For this reason the pin 30 has to be correspondingly dimensioned. Instead of a throughgoing pin, a clamp-like device which surrounds the wire of the chain link may be used.

Turning now to FIGS. 3 to 9, there is illustrated an embodiment wherein the tension force exerted on the chain is used for aligning the chain link to be welded. Consequently, the aligning elements 18 shown in the FIG. 1 embodiment may be omitted here, thus significantly simplifying the apparatus.

The embodiment illustrated in FIGS. 3 to 9 operates in a manner as follows.

Figure 4:
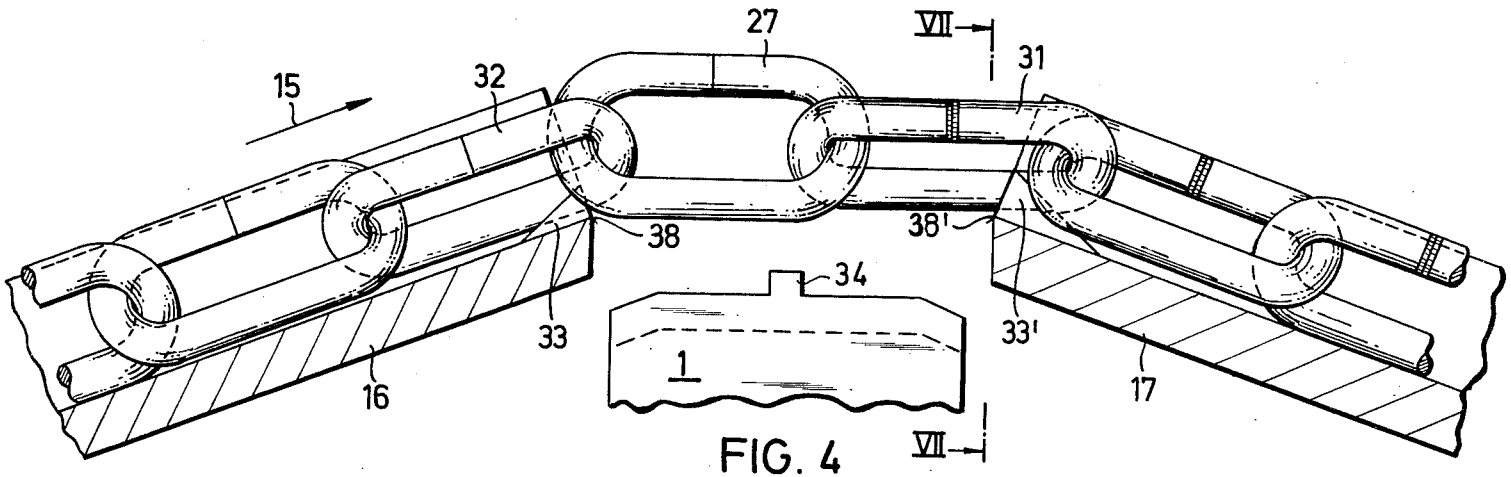
FIGS. 4, 5 and 6 are fragmentary side elevational views on an enlarged scale of a detail of FIG. 3 depicting individual phases of the aligning process performed with that embodiment.
Figure 7:
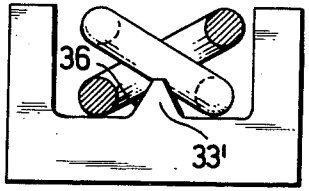
FIG. 7 is a sectional view taken along line VII—VII of FIG. 4.
Figure 5:
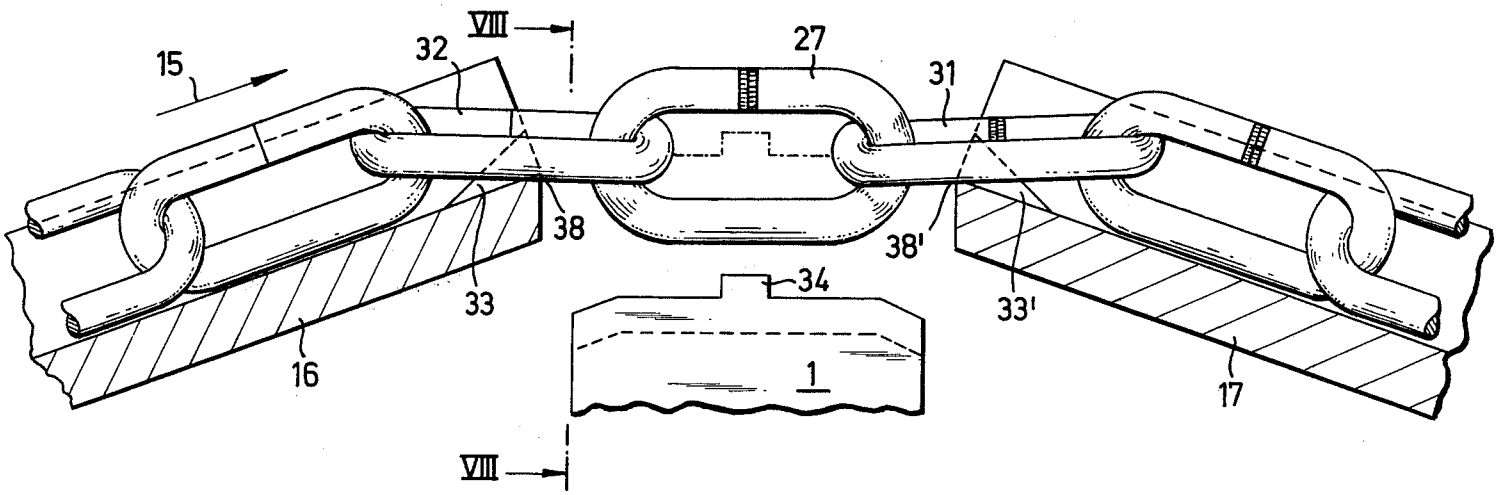
Figure 8:
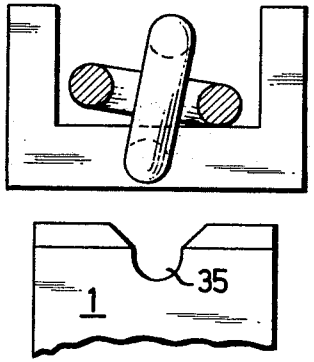
FIG. 8 is a sectional view taken along line VIII—VIII of FIG. 5.

Prior to the welding operation, the saddle 1 is in its lowered position so that the chain may be moved by means of a chain advancing mechanism, not shown, to such an extent that the chain link 27 to be welded is brought into position underneath the welding station. FIGS. 4 and 7 illustrate the position of the individual chain links during the chain advancing step. As soon as the advancing stroke is terminated, both flanking chain links 31 and 32 (that is, those links which adjoin the chain link 27) lie, in the plane formed by their throughgoing legs, entirely on the terminal edges 38 and 38', respectively, of the associated guides 16 and 17 (FIG. 5). Since both terminal edges 38 and 38' are arranged in a coplanar relationship, the two flanking links 31 and 32 will be aligned accordingly, so that they will position the chain link 27 to be welded under the additional effect of the tension force (FIGS. 5 and 8).

Figure 6:
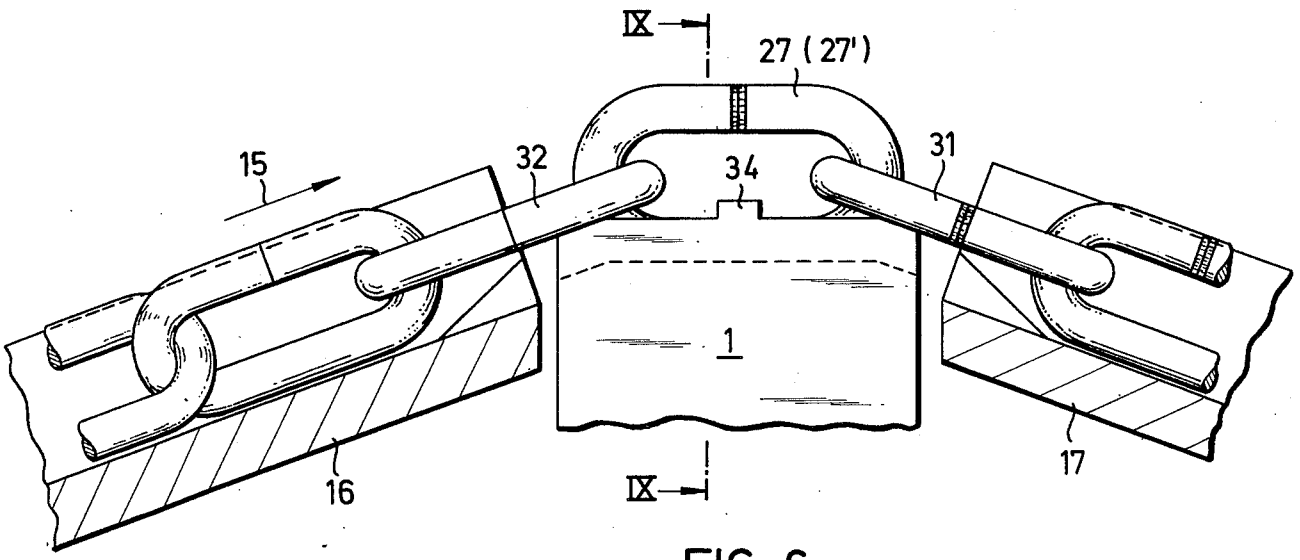
Figure 9:
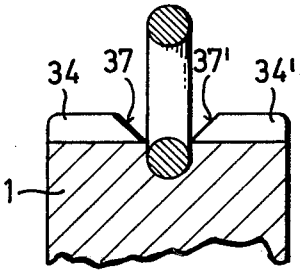
FIG. 9 is a sectional view taken along line IX—IX of FIG. 6.

Thereafter, by means of the saddle lifting device, the saddle 1 is raised to such an extent that it brings the chain link 27 into the dash-line position 27' (FIG. 3), as a result of which the flanking links 31, 32 assume an inclined position. Since the guides are arranged at an angle *a* of preferably 20° to the horizontal, by the flanking chain links 31, 32 there is thus exerted an optimal aligning force on the chain link 27 so that the latter is set in the welding position 27' on the saddle 1 in a practically exact vertical orientation without additional aligning elements (FIGS. 6 and 9).

Thereafter, the upsetting tools and the electrodes are brought into their operational position at the chain link 27. After the completion of the welding step, first the electrodes and then, after a delay determined by the welding conditions, the upsetting tools are withdrawn. Thereafter, the saddle 1 is lowered and the completed, welded chain link is released. Then, by means of the chain advance mechanism the successive chain link is brought into its predetermined position above the saddle 1, whereby the just-welded chain link takes over the function of the flanking link 31, whereas the link 31 itself is now positioned in the guide 17 at 45° to the channel bottom. Thereafter, the above-described welding step takes place.

It is seen that by virtue of the welding process according to the invention there are possible high link chain welding speeds since all movements may be effected with relatively short strokes and thus in the shortest possible time. The end product is a fully welded chain discharged from the welding machine. Thus, intermediate internal transporting devices required in welding processes known heretofore may be omitted, together with all their disadvantages.

As it may be observed in FIG. 4, in the zone of the terminal edge 38 and 38' of the guide 16 and 17, respectively, there are arranged stationary wedge-shaped aligning elements 33 and 33', respectively, which slope towards the guide at their respective side oriented away from the terminal edge of the guide. As it may be observed in the front elevational view of FIG. 7, each stationary aligning element has lateral flanks 36 which slope downwardly in the direction of the lateral edges of the guides and which effect a precise transition of the throughgoing chain link legs into the plane of alignment during chain advance.

As it may be observed in FIGS. 5 and 7, the width of each aligning element 33, 33' is so designed that it is smaller than the lesser width between the legs of a chain link. As a result, in the aligning position the chain link legs of the flanking chain links 32 and 31 engage reliably the aligning edges 38, 38', respectively.

FIGS. 6, 8 and 9 illustrate the saddle 1 which is provided with a groove 35 for receiving a chain link leg. The saddle 1 is further provided with lugs 34, 34' on each side of the groove 35. The lugs 34, 34' have slide surfaces 37, 37', respectively, sloping downwardly towards the groove 35.

As a departure from the structures shown in FIGS. 4, 5 and 6, it is advantageous to design the terminal edges 38, 38' as dismountable parts of the guides 16, 17, respectively. In this manner, for the terminal edges which are exposed to heavy wear, there may be used a highly wear-resistant material, while the other components of the guide may be made of regular steel. It is advantageous to at least provide the ends of the guides in the zone of the terminal edges, for example by means of a welding process, with an armor made of a highly wear-resistant material. Similarly, it is expedient to connect the aligning elements 33, 33' dismountably with the guides 16, 17. In addition to the possibility of replacing the worn aligning elements, it is an advantage of this solution that with adjustable guide walls (FIG. 2) one may at all times associate the aligning element of proper size to adapt the device for particular chain link dimensions.

It will be understood that the above description of the present invention is susceptible to various modifications, changes and adaptations, and the same are intended to be comprehended within the meaning and range of equivalents of the appended claims.

What is claimed is:

1. A method for the successive welding of the joints of consecutive links forming a link chain, comprising the following steps:

a. advancing the chain for bringing a link to be welded directly below a welding position;
b. applying a tensioning force to said chain parallel to the direction of chain advance;
c. during step (b), guiding the two links flanking the link to be welded into a common plane of alignment for effecting a setting of said link to be welded, by the tensioning force, into a plane disposed at 90° to said plane of alignment;
d. raising said link to be welded into a welding position in a plane disposed at 90° to said plane of alignment;
e. firmly maintaining in the welding position the link to be welded;
f. welding the link in the welding position; and
g. subsequent to step (f), lowering the just-welded link from the welding position.

2. A method as defined in claim 1, further comprising the step of guiding a still unwelded chain portion upstream of the welding position and a welded chain portion downstream of the welding position on the legs of the links with the link joint oriented upwardly; said step (c) including the step of raising said flanking links into said common plane of alignment defined by the leg axes of said flanking links.

3. A method as defined in claim 1, further comprising the step of guiding a still unwelded chain portion upstream of the welding position and a welded chain portion downstream of the welding position symmetrically at an inclination with respect to a vertical axis passing through said welding position.

4. A method as defined in claim 1, wherein said plane of alignment has an at least approximately horizontal orientation.

* * * * *